United States Patent [19]

Hauf

[11] 4,019,449

[45] Apr. 26, 1977

[54] AUTOMATIC BUTTONHOLING SIZING DEVICE

[75] Inventor: Robert Conrad Hauf, Upper Montclair, N.J.

[73] Assignee: The Singer Company, New York, N.Y.

[22] Filed: Oct. 18, 1976

[21] Appl. No.: 733,510

[52] U.S. Cl. ..... 112/158 B; 112/77

[51] Int. Cl.[2] ..... D05B 3/02

[58] Field of Search ..... 112/158 B, 158 R, 77, 112/65, 111

[56] References Cited

UNITED STATES PATENTS

| | | | |
|---|---|---|---|
| 3,421,463 | 1/1969 | Happe et al. | 112/77 |
| 3,596,618 | 8/1971 | Goldbach et al. | 112/158 B |
| 3,656,443 | 4/1972 | Ross | 112/158 B |

*Primary Examiner*—H. Hampton Hunter

*Attorney, Agent, or Firm*—Edward L. Bell; Robert E. Smith; Julian Falk

[57] ABSTRACT

An automatic buttonhole sizing device for sewing machines which includes a sensing wheel which by resting on the material being sewn, turns as the material is fed and has a rotatable setting ring which programs the size of the buttonhole. Incorporated in the sensing wheel are one fixed and one movable tab for holding any one of many buttons of various sizes therebetween, wherein the size of the button determines the position of the movable tab. The movable tab is so associated with the setting ring of the sensing wheel that when the two tabs are positioned touching opposite sides of a button by rotating the setting ring, the size of the buttonhole is automatically determined from the final positioning of the setting ring.

3 Claims, 8 Drawing Figures

AUTOMATIC BUTTONHOLING SIZING DEVICE

BACKGROUND OF THE INVENTION

Buttonhole sizing devices, in themselves, are not new, however, previously known buttonhole sizing devices have usually been used to mark the size of proposed buttonholes on a garment before the garment was moved to the sewing position of a sewing machine.

It is also known in the art to provide a buttonholing mechanism associated as a part of a pattern cam arrangement for a needle-jogging and work-feeding mechanism of the sewing machine for automatically varying the pattern cam operation so as to produce the buttonhole stitch formation, wherein a buttonhole sizing device coacts with the above buttonholing mechanism to obtain a desired size of buttonhole. The buttonholing mechanism disclosed in U.S. Pat. No. 3,596,618 by Goldbach to which this invention is related, has a wheel which rests upon the material being sewn so that the wheel turns as the material is being fed to provide sensing pulses at preset intervals which control electromechanisms for the proper operation of a buttonholing assembly of a household zigzag sewing machine. However, the size of the buttonhole must be known or measured in order to preset the sensing wheel for desired size of buttonhole.

SUMMARY OF THE INVENTION

The object of this invention is to provide a means for automatically setting the size of a buttonhole given the button to be used therewith. This object is achieved by incorporating in a buttonhole sensing wheel a set of tabs, one fixed and one movable, for grasping a button; the movable tab being operatively connected to the adjusting ring of the sensing wheel, whereby, when the ring is so set as to urge the tabs together grasping a button, the size of the buttonhole is simultaneously set.

With the above and additional objects and advantages in view as will hereinafter appear, this invention will be described in reference to the accompanying drawings of the preferred embodiment.

DESCRIPTION OF THE PREFERRED EMBODIMENT

Figure 2:
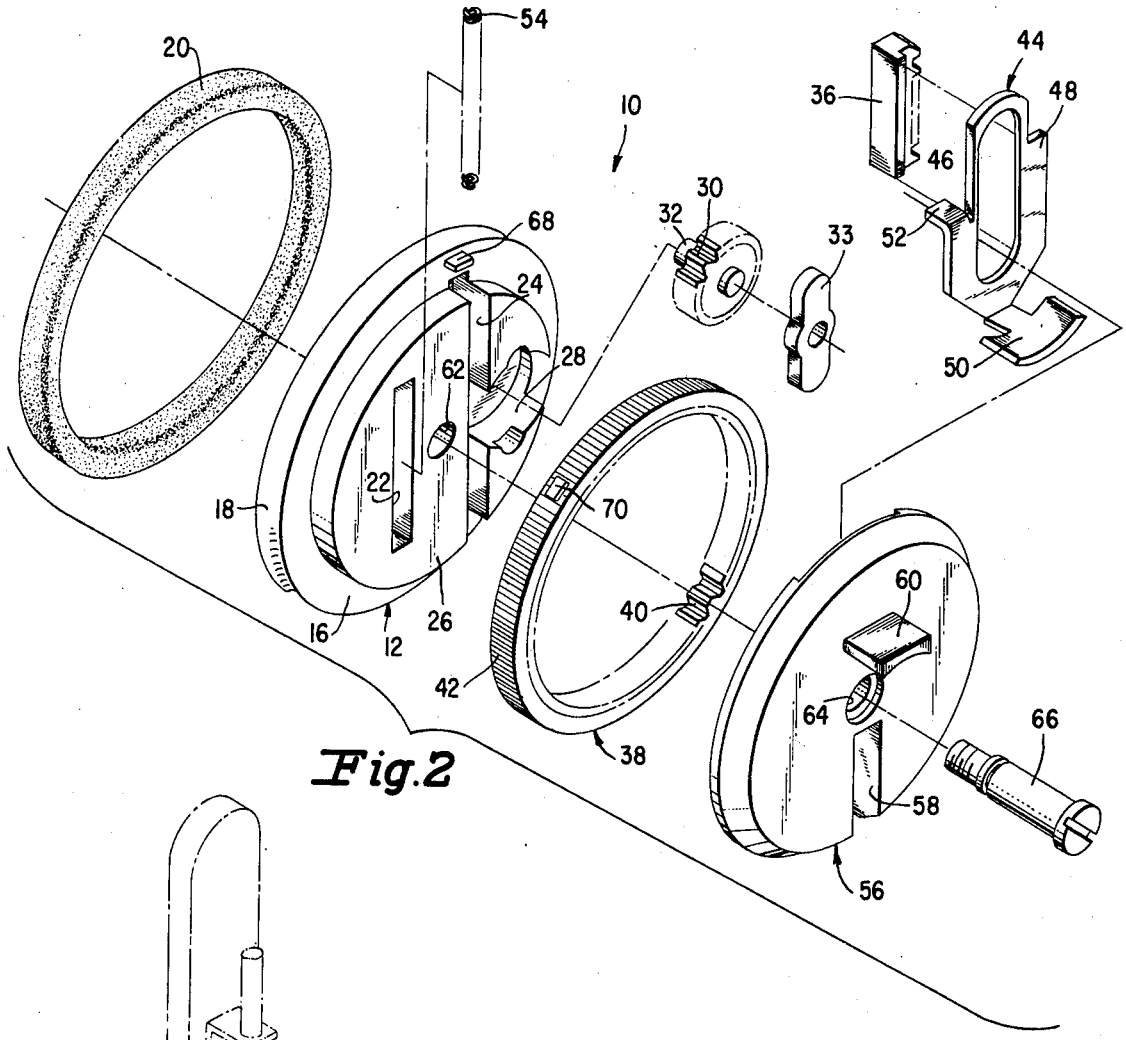
FIG. 2 is an exploded perspective view of the sensing wheel assembly along with the buttonhole sizing device.
Figure 1:
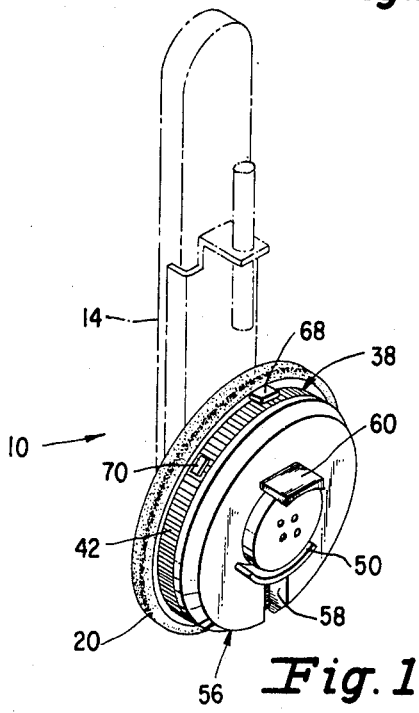
FIG. 1 is a perspective view of the sensing wheel assembly of a buttonholing mechanism having the invention incorporated therein.
Figure 3:
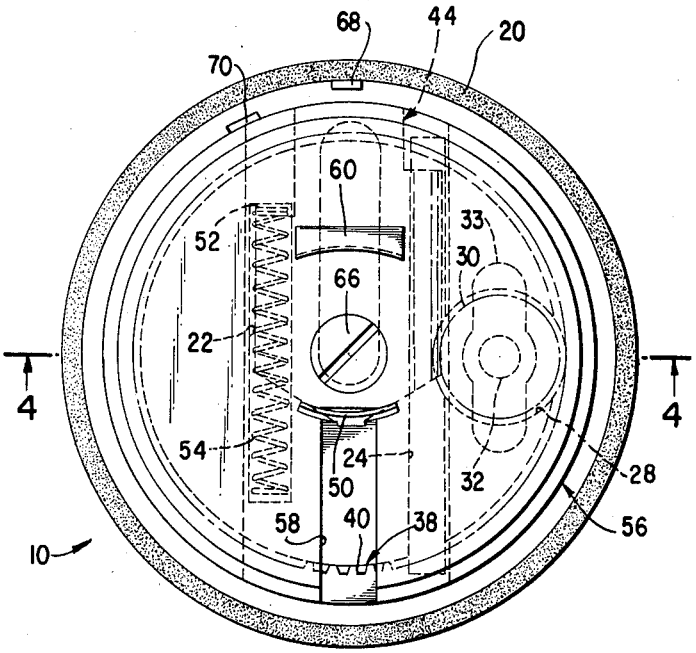
FIG. 3 is a front elevational view of the sensing wheel assembly.
Figure 4:
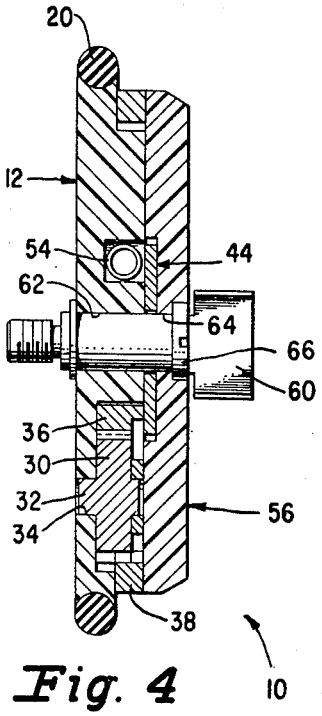
FIG. 4 is a cross-sectional view of the sensing wheel taken along the line 4—4 of FIG. 3.
Figure 5A:
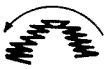
FIGS. 5A, 5B, 5C and 5D show in sequential steps the formation of a buttonhole.
Figure 5B:
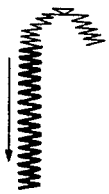
Figure 5C:
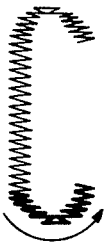
Figure 5D:
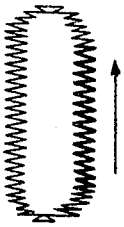

The automatic buttonhole sizing device of this invention, as shown in FIG. 1, forms a part of the sensing wheel assembly of a buttonhole mechanism (not shown) disclosed in U.S. Pat. No. 3,596,618 by Goldbach, to which reference may be had for greater detail.

Referring to the drawings, a sensing wheel assembly is indicated by the reference number 10. The wheel assembly 10 includes a freely rotatable wheel 12 which is secured to a support member 14, and is used to translate the linear motion of the material being sewn into rotary motion. The perimeter of the wheel flange 16 is formed with a groove 18 for receiving an elastomeric O-ring 20 to provide a traction between the wheel 12 and the material. A first and second slots, 22 and 24 respectively, which are parallel to each other, are formed in a side of the wheel hub 26 on opposite side of the center thereof. The first slot 22 is close-ended and centered in the wheel hub 26 while the second slot 24 breaks through the edge of the hub 26. Intersecting both the second slot 24 and the edge of the hub 26 is a circular recess 28 for housing a pinion gear 30. The pinion gear 30 has a central axle 32 for which a hole 34 is provided at the bottom of the recess 28. A retainer 33 is provided for holding the pinion gear in place. Slidably located within the second slot 24 is a rack 36, such that, when both the rack 36 and the pinion gear 30 are positioned within the second slot 24 and the recess 28, respectively, the rack 36 meshes with the teeth of the pinion gear 30.

Surrounding the wheel hub 26 is an adjusting ring 38. The adjusting ring 38 has an internal ring gear 40 for meshing with the pinion gear 30 at the point where the recess 28 intersects the edge of the wheel hub 26. The perimeter of the adjusting ring 38 is formed with a knurl 42 to facilitate manual rotation thereof. As can be seen from this arrangement, by rotating the adjusting ring 38, the internal ring gear 40 urges rotary motion to the pinion gear 30 which, in turn, urges linear motion to the rack 36.

For holding buttons, there is provided a movable frame 44. The movable frame 44 is formed having a central slot 46, and an enlarged flat portion 48 adjacent to the slot 46 for mounting the movable frame 44 to the rack 36. At the bottom of the slot 46, the movable frame 44 is turned up at a right angle forming a buttonholder 50. On the opposite side of the slot 46 from the enlarge portion 48, a tab 52 is bent over in the opposite direction from the buttonholder 50. This tab 52 fits in the first slot 22 in the wheel hub 26. A spring 54 is positioned in the first slot 22 for urging the tab 52 upward.

Encompassing the assembly is a cover 56. The cover 56 is formed with a radial slot 58 for accomodating the movable buttonholder 50. Diametrically opposite the cover slot 58 is mounted a fixed buttonholder 60 toward and away from which the movable buttonholder 50 travels.

Located in the center of both the wheel 12 and the cover 56 are coaxial holes 62 and 64, respectively, through which a mounting screw 66 passes fastening the wheel assembly 10 to the support member 14. The central slot 46 in the movable frame 44 allows the mounting screw 66 to pass therethrough. Details for the mounting of the wheel assembly 10 to a sewing machine is disclosed in U.S. Pat. No. 3,596,618 by Goldbach, to which reference may be had.

For actuating the photo-electric sensors of the Goldbach patent, reflective means, 68 and 70, such as mirrors, are affixed to the wheel flange 16 and the perimeter of the adjusting ring 38, respectively, such that the circumferential distance between the two reflective means 68 and 70, in any position of the adjusting ring 38, approximately equals the spacing between the fixed buttonholder 60 and the movable buttonholder 50.

In operation, a button of the desired size is placed between the fixed buttonholder 60 and the movable buttonholder 50. By rotating the adjusting ring 38, the movable buttonholder 50 is caused to move toward the fixed buttonholder 60 until the button is clamped therebetwen. The resultant spacing between the reflective means, 68 and 70, is equivalent to the diameter of the button and by operating the buttonhole mechanism as disclosed in Goldbach, a properly sized buttonhole will be formed.

Having thus set forth the nature of the invention, what I claim herein is:

1. In a zigzag sewing machine having an endwise reciprocating needle bar, a mechanism for jogging said needle bar laterally to produce zigzag stitches including a member regulating the neutral position of the needle-jogging motion, a work-feeding mechanism including a feed-regulating member having a range of positions corresponding to forward and reverse directions of work feed, an actuating mechanism in said sewing machine operatively connected to impart endwise reciprocatory and lateral vibratory movements to said needle bar and movements to said work-feeding mechanism in timed relation thereto, a buttonholing assembly for controlling the functions of said sewing machine in the formation of a buttonhole, and a sensing wheel assembly for metering the size of the buttonhole being sewn having adjusting means for programming various size buttonholes, in combination with an automatic buttonhole sizing device comprising means for supporting a button for gauging the size of a buttonhole, means or measuring the size of said button, and means for connecting said measuring means to said adjusting means.

2. An automatic buttonhole sizing device as set forth in claim 1 wherein said button supporting means and said button measuring means comprise a fixed and a movable buttonholder attached to said sensing wheel assembly whereby said movable buttonholder is moved toward said fixed buttonholder until said button is sandwiched therebetween, the size of said button then being the distance separating said fixed and movable buttonholders.

3. An automatic buttonhole sizing device as set forth in claim 2 wherein said connecting means comprises a rack and pinion gear set attached to said movable buttonholder and said adjusting means, respectively.

* * * * *